US008614570B2

(12) United States Patent
Hirose et al.

(10) Patent No.: US 8,614,570 B2
(45) Date of Patent: Dec. 24, 2013

(54) REFERENCE CURRENT SOURCE CIRCUIT INCLUDING ADDED BIAS VOLTAGE GENERATOR CIRCUIT

(75) Inventors: Tetsuya Hirose, Hyogo (JP); Yuji Osaki, Hyogo (JP)

(73) Assignee: Semiconductor Technology Academic Research Center, Kanagawa (JP)

( * ) Notice: Subject to any disclaimer, the term of this patent is extended or adjusted under 35 U.S.C. 154(b) by 252 days.

(21) Appl. No.: 13/192,854

(22) Filed: Jul. 28, 2011

(65) Prior Publication Data

US 2012/0025801 A1 Feb. 2, 2012

(30) Foreign Application Priority Data

Jul. 30, 2010 (JP) ..... P2010-172391
Jul. 19, 2011 (JP) ..... P2011-157568

(51) Int. Cl.
*G05F 3/16* (2006.01)
*G05F 1/10* (2006.01)

(52) U.S. Cl.
USPC ..... 323/313; 323/315; 327/538; 327/539; 327/543

(58) Field of Classification Search
USPC ..... 323/313–316; 327/538–539, 543
See application file for complete search history.

(56) References Cited

U.S. PATENT DOCUMENTS 4,359,680 A * 11/1982 Hellums et al. ..... 323/313
5,200,654 A * 4/1993 Archer ..... 327/362
6,191,645 B1 * 2/2001 Digele ..... 327/543
6,198,350 B1 * 3/2001 Zarabadi ..... 330/297
7,417,487 B2 * 8/2008 Mori ..... 327/512
2005/0270011 A1 * 12/2005 Aota et al. ..... 323/315
2007/0164722 A1 * 7/2007 Rao et al. ..... 323/315
2007/0200546 A1 * 8/2007 Logiudice et al. ..... 323/316
2009/0302824 A1 * 12/2009 Kim et al. ..... 323/313
2010/0046580 A1 * 2/2010 Hasegawa ..... 374/178

(Continued)

FOREIGN PATENT DOCUMENTS

JP 2010-231774 10/2010

OTHER PUBLICATIONS

K. Ueno et al., "*A 300-nW, 15-ppm/° C., 20-ppm/V CMOS voltage reference circuit consisting of subthreshold MOSEFETs*", IEEE Journal of Solid-State Circuits, vol. 44, No. 7, pp. 2047-2054, Jul. 2009.

(Continued)

*Primary Examiner* — Timothy J Dole
*Assistant Examiner* — Yusef Ahmed
(74) *Attorney, Agent, or Firm* — Wenderoth, Lind & Ponack, L.L.P.

(57) ABSTRACT

A MOS transistor generates an output current based on a voltage induced across a drain and a source thereof. A gate bias voltage generator circuit generates a gate bias voltage so as to operate the MOS transistor in a strong-inversion linear region, and applies the gate bias voltage to a gate of the MOS transistor. A drain bias voltage generator circuit generates a drain bias voltage, and applies the drain bias voltage to the drain of the MOS transistor. An added bias voltage generator circuit generates an added bias voltage, which has a predetermined temperature coefficient and includes a predetermined offset voltage, so that the output current becomes constant against temperature changes. The drain bias voltage generator circuit adds the added bias voltage to the drain bias voltage, and applies a voltage of the adding results to the drain of the MOS transistor as the drain bias voltage.

10 Claims, 11 Drawing Sheets

(56) References Cited

U.S. PATENT DOCUMENTS

| | | | | |
|---|---|---|---|---|
| 2010/0073032 | A1* | 3/2010 | Abe et al. | 327/50 |
| 2010/0164461 | A1* | 7/2010 | Hirose et al. | 323/285 |
| 2010/0225384 | A1 | 9/2010 | Hirose et al. | |
| 2011/0001546 | A1* | 1/2011 | Guo et al. | 327/512 |

OTHER PUBLICATIONS

Toyoaki Kito et al., "*Current reference circuit by using temperature characteristics of carrier mobility*", Proceedings of the 2009 IEICE general conference, A-1-40, The Institute of Electronics, Information and Communication Engineers (IEICE), Mar. 2009 with its partial English translation.

Y. Taur et al., "*Fundamentals of modern VLSI devices*", Cambridge University Press, 2002, pp. 19-20.

C.H. Lee et al., "*All-CMOS temperature independent current reference*", Electronics Letters, vol. 32, No. 14, pp. 1280-1281, Jul. 1996.

J. Georgious et al., "*A resistorless low current reference circuit for implantable devices*", in Proceedings of IEEE International Symposium on Circuits and Systems (ISCAS), vol. 3, pp. 193-196, May 2002.

W.M. Sansen et al., "*A COMS Temperature-Compensated Current Reference*", IEEE Journal of Solid-State Circuits, vol. 23, No. 3, pp. 821-824, Jun. 1988.

H.J. Oguey et al., "*CMOS Current Reference Without Resistance*", IEEE Journal of Solid-State Circuits, vol. 32, No. 7, pp. 1132-1135, Jul. 1997.

* cited by examiner

1C
I32
CM13
MP34
MP32
MN33
100C
GB1
I31
MP33
MP31
MN31
MN32
IREF
MP24
MP22
MN24
MN22
DB3
VGB
VDD
MR
VGS1
VGS2
VDSR
20C
I21
MP23
MP21
MN23
MN21
N
CG13
I11
MP12
MP11
M0
M1
M2
M3
N4
M4
VSR=VD4
10
CG14
M5
M6
M7
M8
M9
MP407
50
I407
MP408
I402
MN402
MN401
40
I401
41
MP401
MP402
MP403
MP404
MP405
MP406

REFERENCE CURRENT SOURCE CIRCUIT INCLUDING ADDED BIAS VOLTAGE GENERATOR CIRCUIT

The disclosure of Japanese Patent Application No. 2010-172391 filed Jul. 30, 2010 including specification, drawings and claims is incorporated herein by reference in its entirety. In addition, the disclosure of Japanese Patent Application No. 2011-157568 filed Jul. 19, 2011 including specification, drawings and claims is incorporated herein by reference in its entirety.

BACKGROUND OF THE INVENTION

1. Field of the Invention

The present invention relates to a reference current source circuit including Metal Oxide Semiconductor Field Effect Transistors operated in a subthreshold region.

2. Description of the Related Art

As a technique for remarkably reducing the power consumption of a circuit system, there has been a method of designing a circuit system on such an assumption that a Metal Oxide Semiconductor Field Effect Transistor (referred to as a MOSFET hereinafter) is operated in the subthreshold region. Electrical characteristics of a MOSFET in the subthreshold region have such a problem that the characteristics sensitively vary with respect to temperature changes and process variations. In order to stably operate such a circuit system, it is required to consistently supply a constant current in all of possible environments. Therefore, it is required to constitute a reference current source circuit that has very low power consumption and stably operates with respect to temperature changes and power supply voltage fluctuations.

Prior art documents related to the present invention are listed below:

Japanese patent laid-open publication No. JP 2010-231774-A (referred to as a Patent Document 1 hereinafter);

United States patent application publication No. US2010/0225384 A1 (referred to as a Patent Document 2 hereinafter);

K. Ueno et al., "A 300-nW, 15-ppm/° C., 20-ppm/V CMOS voltage reference circuit consisting of subthreshold MOSFETs", IEEE Journal of Solid-State Circuits, Vol. 44, No. 7, pp. 2047-2054, July 2009 (referred to as a Non-Patent Document 1 hereinafter);

Toyoaki Kito, et al., "Current reference circuit by using temperature characteristics of carrier mobility", Proceedings of the 2009 IEICE general conference, A-1-40, The Institute of Electronics, Information and Communication Engineers (IEICE), March 2009 (referred to as a Non-Patent Document 2 hereinafter);

Y. Taur et al., "Fundamentals of modern VLSI devices", Cambridge University Press, 2002, pp. 19-20 (referred to as a Non-Patent Document 3 hereinafter);

C. H. Lee et al., "All-CMOS temperature independent current reference", Electronics Letters, Vol. 32, No. 14, pp. 1280-1281, July 1996 (referred to as a Non-Patent Document 4 hereinafter);

J. Georgious et al., "A resistorless low current reference circuit for implantable devices", in Proceedings of IEEE International Symposium on Circuits and Systems (ISCAS), Vol. 3, pp. 193-196, May 2002 (referred to as a Non-Patent Document 5 hereinafter);

W. M. Sansen et al., "A CMOS Temperature-Compensated Current Reference", IEEE Journal of Solid-State Circuits, Vol. 23, No. 3, pp. 821-824, June 1988 (referred to as a Non-Patent Document 6 hereinafter); and H. J. Oguey et al., "CMOS Current Reference Without Resistance", IEEE Journal of Solid-State Circuits, Vol. 32, No. 7, pp. 1132-1135, July 1997 (referred to as a Non-Patent Document 7).

There has been proposed a voltage source circuit that outputs a threshold voltage of a MOSFET at an absolute zero temperature (See the Non-Patent Document 1). It is proposed to utilize this voltage source circuit as a voltage source, and a current flowing through this voltage source circuit has characteristics stable to LSI manufacturing process variations and power supply voltage fluctuations. However, when the voltage source circuit is used as a current source, a current flowing through the voltage source circuit has a temperature characteristic, and this has led such a problem that the amount of current increases when the temperature rises.

Considering this situation, there has been proposed a current source circuit for improving the changes in the temperature characteristic (See the Patent documents 1 and 2, and the Non-Patent Document 2). This current source circuit utilizes a difference in a dependence of a temperature and a degree of electron transfer (referred to as an electron mobility hereinafter), which is a conduction carrier of an n-channel MOSFET (referred to as an nMOS transistor hereinafter), and a dependence of a temperature and a degree of hole transfer (referred to as a hole mobility hereinafter), which is a conduction carrier of a p-channel MOSFET (referred to as a pMOS transistor hereinafter). Since the dependence of the temperature and the electron mobility, and the dependence of the temperature and the hole mobility are different from each other, the current source circuit of the Patent documents 1 and 2, and the Non-Patent Document 2 controls a temperature characteristic of an outputted reference current by generating currents dependent on the respective mobilities, and subtracting one of these currents from another one of these currents.

However, this current source circuit requires using two current source circuits that have complementary structures for generating the currents dependent on the mobilities of two kinds, and requires using a current subtracting circuit for the subtraction of the currents, and this leads to such a problem that the circuit area and the power consumption increase.

SUMMARY OF THE INVENTION

It is an object of the present invention to provide a reference current source circuit capable of solving the above-described problems, reducing the circuit area as compared with that of the prior art, and controlling an inclination of a temperature characteristic of an output current to be zero at a room temperature.

In order to achieve the above-mentioned objective, according to one aspect of the present invention, there is provided a reference current source circuit including a first current mirror circuit, a MOS transistor, a gate bias voltage generator circuit, a drain bias voltage generator circuit, and an added bias voltage generator circuit. The first current mirror circuit generates a plurality of first minute currents from a power supply voltage, where the plurality of first minute currents correspond to each other. The MOS transistor has a gate, a drain and a source, and generates an output current based on a voltage induced across the drain and the source. The gate bias voltage generator circuit includes a plurality of first MOS transistors operating in a subthreshold saturation region based on a plurality of first minute currents selected from the plurality of first minute currents, generates a gate bias voltage so as to operate the MOS transistor in a strong-inversion linear region based on selected first minute currents, and applies the gate bias voltage to the gate of the MOS transistor.

The drain bias voltage generator circuit includes a plurality of second MOS transistors operating in the subthreshold saturation region based on a plurality of first minute currents selected from the plurality of first minute currents, generates a drain bias voltage based on selected first minute currents, and applies the drain bias voltage to the drain of the MOS transistor. The added bias voltage generator circuit generates an added bias voltage, which has a predetermined temperature coefficient and includes a predetermined offset voltage, based on one first minute current selected from the plurality of first minute currents, so that the output current becomes constant against temperature changes. The drain bias voltage generator circuit adds the added bias voltage to the drain bias voltage, and applies a voltage of the adding results to the drain of the MOS transistor as the drain bias voltage.

In the above-described reference current source circuit, the added bias voltage generator circuit preferably includes a MOS transistor ladder circuit. The MOS transistor ladder circuit includes a first nMOS transistor which is diode-connected and operates in the subthreshold saturation region based on the one first minute current, and a second nMOS transistor, which is connected in series to the first nMOS transistor via a connection point and operates in a subthreshold linear region based on the one first minute current. The MOS transistor ladder circuit outputs a voltage generated at the connection point as the added bias voltage.

In addition, in the above-described reference current source circuit, the first nMOS transistor is preferably selected from the plurality of second MOS transistors.

Further, in the above-described reference current source circuit, the added bias voltage generator circuit preferably includes a MOS transistor ladder circuit. The MOS transistor ladder circuit includes a first nMOS transistor which is diode-connected and operates in the subthreshold saturation region based on the one first minute current, and a plurality of second nMOS transistors, which are connected in series to the first nMOS transistor via a first connection point, operate in a subthreshold linear region based on the one first minute current, and are connected in series with each other via at least one second connection point. The MOS transistor ladder circuit outputs a voltage generated at one of the first connection point and the at least one second connection point as the added bias voltage.

Still further, in the above-described reference current source, the first nMOS transistor is preferably selected from the plurality of second MOS transistors.

In addition, in the above-described reference current source circuit, the plurality of second nMOS transistors are preferably connected between the first connection point and a ground. The added bias voltage generator circuit further includes a plurality of switches connected between the first connection point and the ground, and between each of the at least one second connection point and the ground, respectively. One of the plurality of switches is controlled to be turned on.

Further, in the above-described reference current source circuit, the first current mirror circuit preferably includes a plurality of cascode current mirror circuits.

Still further, the above-described reference current source circuit preferably further includes a startup circuit. The startup circuit includes a detector circuit for detecting a non-operating time of the reference current source circuit, and a startup transistor circuit for starting up the reference current source circuit by flowing a predetermined startup current through the reference current source circuit when the non-operating time of the reference current source circuit is detected by the detector circuit.

In addition, in the above-described reference current source circuit, the startup circuit preferably further includes a current supply circuit for supplying a bias operating current to the detector circuit. The current supply circuit includes a third minute current generator circuit for generating a predetermined second minute current from the power supply voltage, and a second current mirror circuit for generating a third minute current corresponding to the second minute current as the bias operating current.

According to the reference current source circuit of the present invention, the added bias generator circuit generates the added bias voltage, which has the predetermined temperature coefficient and includes the predetermined offset voltage, and the drain bias voltage generator circuit adds the added bias voltage to the drain bias voltage and applies the voltage of the adding results to the drain of the MOS transistor. Therefore, the inclination of the temperature characteristic of the output current can be controlled to be zero at the room temperature, and the reference current source circuit can supply a constant output current stable to variations (referred to as PVT variations hereinafter) including a process variation, a power supply voltage variation and a temperature variation. In addition, since the added bias generator circuit has one current path, the reference current source circuit of the present invention can be configured to have a circuit area equal to or smaller than half of that of the prior art current source circuit, and the power consumption can be reduced.

In addition, according to the reference current source circuit of the present invention, by using only one common nMOS transistor instead of the first nMOS transistor that operates in the subthreshold saturation region in the added bias generator circuit and the nMOS transistor that operates in the subthreshold saturation region in the drain bias voltage generator circuit, the number of transistors can be reduced as compared with that of the above-described reference current source circuit.

Further, according to the reference current source circuit of the present invention, the reference current source circuit is configured to include the startup circuit. The startup circuit operates only when an operating current is not flowing through the reference current source circuit so as to flow the operating current through the reference current source circuit, and the startup circuit does not operate when the operating current flows through the reference current source circuit. Therefore, the reference current source circuit operates at a normal operating point.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
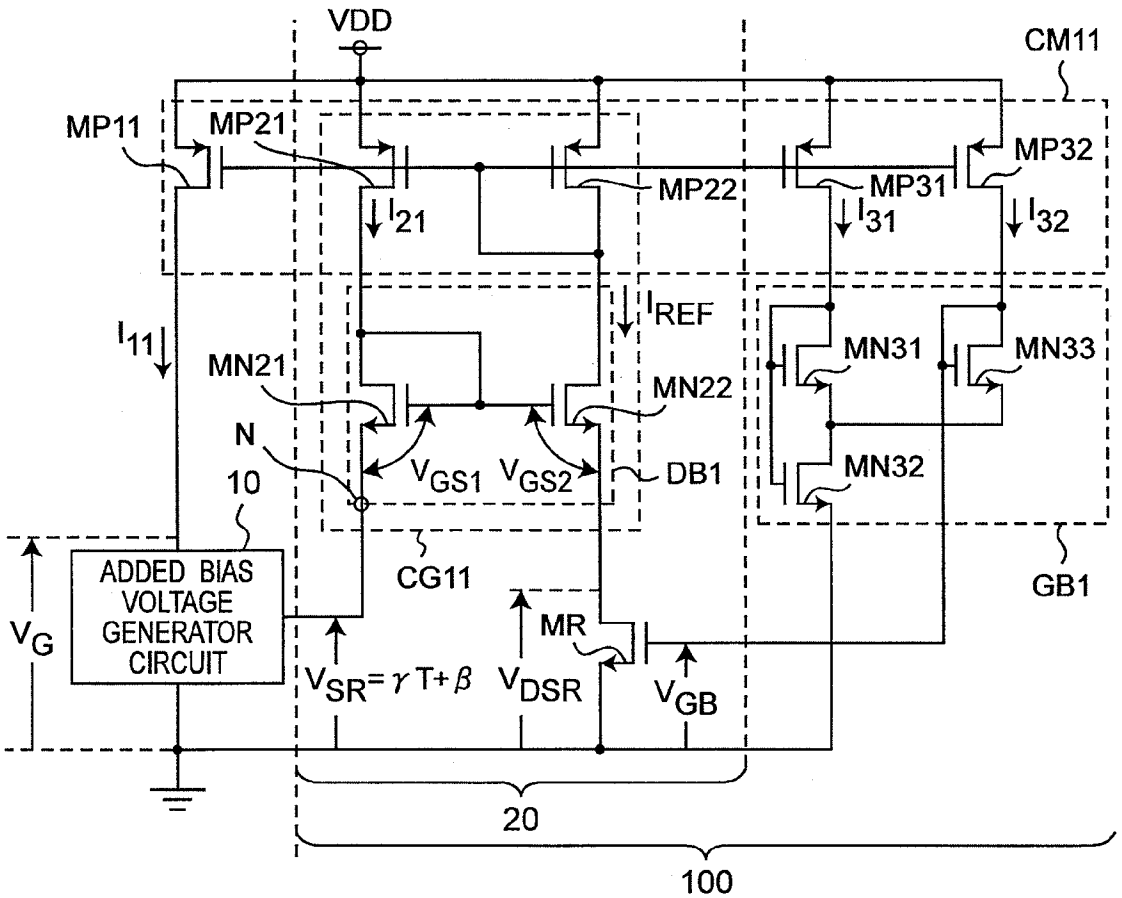
FIG. 1 is a circuit diagram showing a configuration of a reference current source circuit 1 according to a first preferred embodiment of the present invention.

Preferred embodiments according to the present invention will be described below with reference to the attached drawings. Components similar to each other are denoted by the same reference numerals and will not be described herein in detail.

First Preferred Embodiment

A reference current source circuit 1 according to the first preferred embodiment of the present invention is configured to further include an added bias generator circuit 10 for generating an added bias voltage $V_{SR}$ including a minute offset voltage β in the voltage source circuit disclosed in the Non-Patent Document 1, so as to improve the temperature dependence of an output current $I_{REF}$.

FIG. 1 is a circuit diagram showing a configuration of the reference current source circuit 1 according to the first preferred embodiment of the present invention. Referring to FIG. 1, the reference current source circuit 1 is configured to include a current source circuit 100 and the added bias generator circuit 10. Further, the current source circuit is configured to include a current mirror circuit CM11, a gate bias voltage generator circuit GB1, a drain bias voltage generator circuit DB1, and a MOS transistor MR.

The reference current source circuit 1 of the first preferred embodiment includes:

the current mirror circuit CM11 for generating minute currents $I_{11}$, $I_{21}$, $I_{REF}$, $I_{31}$ and $I_{32}$ from a power supply voltage from a power source VDD, the minute currents $I_{11}$, $I_{21}$, $I_{REF}$, $I_{31}$ and $I_{32}$ corresponding to each other;

the MOS transistor MR having a gate, a drain and a source, and generating the output current $I_{REF}$ based on a voltage $V_{DSR}$ induced across the drain and the source;

the gate bias voltage generator circuit GB1 including nMOS transistors MN31, MN32 and MN33 each operating in a subthreshold saturation region based on the minute currents $I_{31}$ and $I_{32}$, generating a gate bias voltage $V_{GB}$ so as to operate the MOS transistor MR in a strong-inversion linear region based on the minute currents $I_{31}$ and $I_{32}$, and applying the gate bias voltage $V_{GB}$ to the gate of the MOS transistor MR;

the drain bias voltage generator circuit DB1 including nMOS transistors MN21 and MN22 each operating in the subthreshold saturation region based on the minute currents $I_{21}$ and $I_{REF}$, generating a drain bias voltage ($V_{GS1}-V_{GS2}$) based on the minute currents $I_{21}$ and $I_{REF}$, and applying the drain bias voltage ($V_{GS1}-V_{GS2}$) to the drain of the MOS transistor MR; and the added bias voltage generator circuit 10 for generating the added bias voltage $V_{SR}$, which has a predetermined temperature coefficient γ and includes the predetermined offset voltage β, based on the minute current $I_{11}$, so that the output current $I_{REF}$ becomes constant against temperature changes.

In this case, the drain bias voltage generator circuit DB1 adds the added bias voltage $V_{SR}$ to the drain bias voltage ($V_{GS1}-V_{GS2}$), and applies a voltage ($VS_R+V_{GS1}-V_{GS2}$) of the adding results to the drain of the MOS transistor MR as the drain bias voltage $V_{DSR}$.

Referring to FIG. 1, the current mirror circuit CM11 is configured to include pMOS transistors MP11, MP21, MP22, MP31, and MP32. In addition, the gate bias voltage generator circuit GB1 is configured to include the nMOS transistors MN31, MN32, and MN33. Further, the drain bias voltage generator circuit DB1 is configured to include the nMOS transistors MN21 and MN22, and includes a current control terminal N. In this case, the pMOS transistors MP21 and MP22, and the drain bias voltage generator circuit DB1 constitute a minute current generator circuit CG11, and the minute current generator circuit CG11 and the MOS transistor MR being a nMOS transistor constitute a current generator circuit 20.

In the current generator circuit 20, a source of the pMOS transistor MP21 is connected to the power source VDD. A drain of the pMOS transistor MP21 is connected to a drain of the nMOS transistor MN21. A source of the pMOS transistor MP22 is connected to the power source VDD, and a drain of the pMOS transistor MP22 is connected to a gate of the pMOS transistor MP22 and a drain of the nMOS transistor MN22. A gate of the nMOS transistor MN21 is connected to a gate of the nMOS transistor MN22 and the drain of the nMOS transistor MN21, and the source of the nMOS transistor MN21 is connected to the current control terminal N. A source of the nMOS transistor MN22 is connected to a drain of the MOS transistor MR. A gate of the MOS transistor MR is connected to a connection point between a drain of the pMOS transistor MP32 and a drain of the nMOS transistor MN33, and a source of the MOS transistor MR is grounded.

In addition, a source of the pMOS transistor MP31 is connected to the power source VDD, and a drain of the pMOS transistor MP31 is connected to a drain of the nMOS transistor MN31, a gate of the nMOS transistor MN31, and a gate of the nMOS transistor MN32. A source of the nMOS transistor MN31 is connected to a drain of the nMOS transistor MN32, and a source of the nMOS transistor MN33. A source of the nMOS transistor MN32 is grounded. A source of the pMOS transistor MP32 is connected to the power source VDD, and the drain of the pMOS transistor MP32 is connected to the drain of the nMOS transistor MN33, the gate of the nMOS transistor MN33, and the gate of the MOS transistor MR.

Further, a gate of the pMOS transistor MP11 is connected to the gate of the pMOS transistor MP21, a source of the pMOS transistor MP11 is connected to the power source VDD, and a drain of the pMOS transistor MP11 is connected to the added bias voltage generator circuit 10.

In the reference current source circuit 1, the drain bias voltage generator circuit DB1 and the gate bias voltage generator circuit GB1 have configurations similar to those of the drain bias voltage generator circuit and the gate bias voltage generator circuit shown in the Patent Documents 1 and 2, and the Non-Patent Document 2, respectively. In addition, referring to FIG. 1, the current mirror circuit CM11 generates the minute currents $I_{11}$, $I_{21}$, $I_{31}$ and $I_{32}$ from the power supply voltage from the power source VDD, where the minute currents $I_{11}$, $I_{21}$, $I_{31}$ and $I_{32}$ correspond to the output current $I_{REF}$ flowing through the pMOS transistor MP22. The minute current $I_{11}$ is outputted to the added bias voltage generator circuit 10, and the minute currents $I_{21}$, $I_{31}$ and $I_{32}$ flow through the pMOS transistors MP21, MP31 and MP32, respectively. In the minute current generator circuit CG11, a minute current corresponding to the output current $I_{REF}$ flowing through the pMOS transistor MP22 and the nMOS transistor MN22 flows through the pMOS transistor MP21 and the nMOS transistor MN21. The nMOS transistors MN31 and MN33 constitute a differential pair. In the voltage source circuit of the Patent documents 1 and 2, and the Non-Patent Document 2, a two-stage differential pair is used in the gate bias voltage generator circuit in order to obtain a constant voltage with respect to the temperature. However, since the voltage constant against the temperature is not required when a current is generated, the gate bias voltage generator circuit GB1 uses a one-stage differential pair.

In the current mirror circuit CM11 of FIG. 1, each of the pMOS transistors MP11, MP21, MP22, MP31 and MP32 operates in the subthreshold saturation region. In addition, in the gate bias voltage generator circuit GB1, the nMOS transistors MN31, MN32 and MN33 operate in the subthreshold saturation region based on the minute currents $I_{31}$ and $I_{32}$. The gate bias voltage generator circuit GB1 generates the gate bias voltage $V_{GB}$ so as to operate the MOS transistor MR in the strong-inversion linear region based on the minute currents $I_{31}$ and $I_{32}$, and applies the gate bias voltage $V_{GB}$ to the gate of the MOS transistor MR. Since a MOS transistor operating in the strong-inversion linear region can be treated as a resistor (See the Patent Documents 1 and 2), the MOS transistor MR operates as a resistor.

In addition, referring to FIG. 1, the added bias voltage generator circuit 10 generates the added bias voltage $V_{SR}$ (=γT+3), which has the temperature coefficient γ and includes the predetermined offset voltage β, based on the minute current $I_{11}$, and applies the added bias voltage $V_{SR}$ to the current control terminal N. Further, in the drain bias voltage generator circuit DB1, the nMOS transistors MN21 and MN22 operate in the subthreshold saturation region based on the minute currents $I_{21}$ and $I_{REF}$. Then, the drain bias voltage generator circuit DB1 generates a voltage ($V_{GS1}-V_{GS2}$) represented by a gate-source voltage $V_{GS1}$ of the nMOS transistor MN21 and a gate-source voltage $V_{GS2}$ of the nMOS transistor MN22, adds the added bias voltage $V_{SR}$ to the voltage ($V_{GS1}-V_{GS2}$), and applies a voltage of the adding results to the drain of the MOS transistor MR as the drain bias voltage $V_{DSR}$. As a result, the output current $I_{REF}$ corresponding to the drain bias voltage $V_{DSR}$ applied between the drain and the source of the MOS transistor MR flows through the MOS transistor MR.

The operation of the reference current source circuit 1 is described in detail below.

Generally speaking, in a case where a MOSFET operates in the subthreshold region, a current I (also referred to as a subthreshold current) flowing through the MOSFET is expressed by the following Equation (1) when a drain-source voltage $V_{DS}$ is, for example, equal to or lower than 0.1 V (in the subthreshold linear region):

$$I = KI_0\exp\left(\frac{V_{GS}-V_{TH}}{\eta V_T}\right)\left(1-\exp\left(-\frac{V_{DS}}{V_T}\right)\right), \tag{1}$$

where K (=W/L) denotes an aspect ratio between a channel length L and a channel width W, $I_0$ (=μCox(η−1)$V_T^2$) denotes a prefixed coefficient of a subthreshold current, denotes a carrier mobility, $C_{OX}$(=$\in_{ox}/t_{ox}$) denotes an oxide film capacitance per unit area, $t_{ox}$ denotes an oxide film thickness, $\in_{ox}$ denotes a dielectric constant of the oxide film, η denotes a subthreshold slope coefficient, $V_T$(=$k_B$T/q) denotes a thermal voltage, $k_B$ denotes the Boltzman's constant, T denotes an absolute temperature, q denotes an elementary charge, $V_{GS}$ denotes a gate-source voltage, and $V_{TH}$ denotes a threshold voltage (See the Non-Patent Document 3).

In addition, when the drain-source voltage $V_{DS}$ is, for example, equal to or higher than 0.1 V (in the subthreshold saturation region), the current I flowing through the MOSFET is expressed by the Equation (2):

$$I = KI_0\exp\left(\frac{V_{GS}-V_{TH}}{\eta V_T}\right). \tag{2}$$

In addition, the temperature dependence of the carrier mobility is expressed by the Equation (3):

$$\mu(T) = \mu_0\left(\frac{T}{T_0}\right)^{-m}, \tag{3}$$

where, $\mu_0$ is the carrier mobility at the room temperature $T_0$, and m is a temperature coefficient of the carrier mobility.

The output current $I_{REF}$ flowing through the reference current source circuit 1 of FIG. 1 depends on electrical characteristics of the MOS transistor MR which operates in the strong-inversion linear region. When the drain-source voltage $V_{DSR}$ of the MOS transistor MR is sufficiently small, the output current $I_{REF}$ is expressed by the Equation (4):

$$I_{REF}=\mu C_{OX}K_R(V_{GS}-V_{TH})V_{DSR} \tag{4}.$$

It is herein considered a case where the added bias voltage $V_{SR}$, which has the minute offset voltage β and is generated by the added bias generator circuit 10, is included in the drain-source voltage $V_{DSR}$. In this case, the drain-source voltage $V_{DSR}$ of the MOS transistor MR can be expressed by the Equation (5):

$$V_{DSR}=\Delta T+\beta \tag{5},$$

where α denotes a temperature coefficient of the drain-source voltage $V_{DSR}$, and includes the temperature coefficient γ of the added bias voltage $V_{SR}$.

According to the Equations (3) to (5), a temperature characteristic $TC_I$ of the output current $I_{REF}$ is expressed by the Equation (6):

$$TC_I = \frac{1}{I_{REF}}\frac{\partial I_{REF}}{\partial T} \quad (6)$$
$$= \frac{1}{\mu}\frac{d\mu}{dT} + \frac{1}{(V_{GS}-V_{TH})}\frac{d(V_{GS}-V_{TH})}{dT} + \frac{1}{V_{DSR}}\frac{dV_{DSR}}{dT}$$
$$= \frac{-m}{T} + \frac{1}{T} + \frac{\alpha}{\alpha T+\beta}$$
$$= \frac{1-m}{T} + \frac{1}{T+\beta/\alpha}.$$

When a possible range of a value of $\beta/\alpha$ in the Equation (6) is considered, a value of the second term of the right member of the Equation (6) varies from 0 to 1/T. Since the temperature coefficient m of the carrier mobility of a general CMOS transistor is about 1.5 (See the Non-Patent Document 3), the inclination of the temperature characteristic $TC_I$ of the output current $I_{REF}$ can be made zero at the room temperature by setting $\beta/\alpha$ to an appropriate value.

Figure 2:
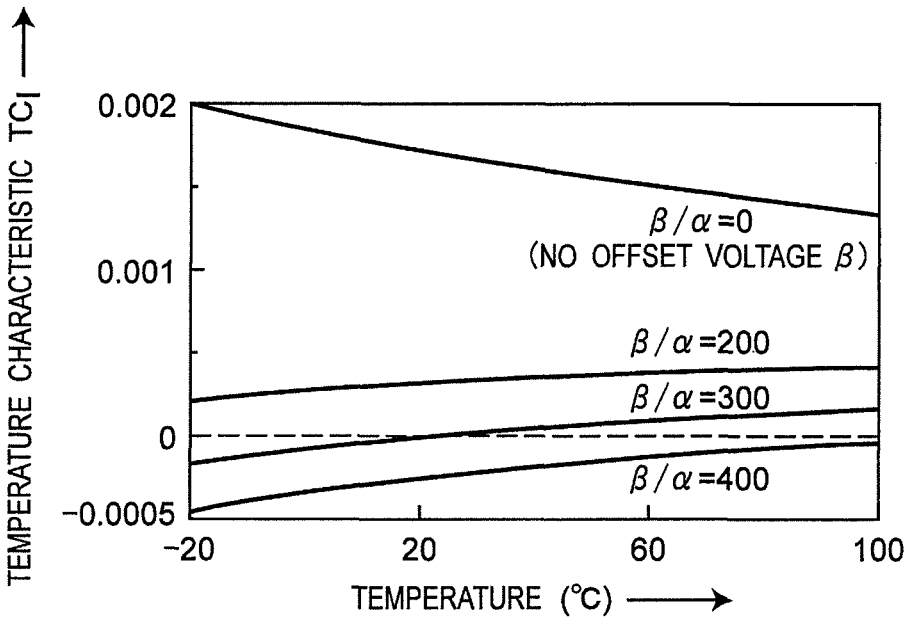
FIG. 2 is a graph showing numerical calculation results of a temperature characteristic $TC_I$ of an output current $I_{REF}$ generated by the reference current source circuit 1 of FIG. 1 with respect to the temperature.

FIG. 2 is a graph showing numerical calculation results of the temperature characteristic $TC_I$ of the output current $I_{REF}$ generated by the reference current source circuit 1 of FIG. 1 with respect to the temperature. When the offset voltage $\beta$ is zero (i.e., when $\beta/\alpha=0$), the temperature characteristic $TC_I$ consistently becomes positive within a temperature range of −20° C. to 100° C. This means that the output current $I_{REF}$ increases following the rise of the temperature. In addition, as shown in FIG. 2, the temperature characteristic $TC_I$ can be changed by the offset voltage $\beta$. In particular, when $\beta/\alpha=300$, the inclination of the temperature characteristic $TC_I$ can be made zero at the room temperature. Therefore, by setting $\beta/\alpha$ to an appropriate value, it is possible to obtain the output current $I_{REF}$ having improved temperature dependence.

As described above, the temperature dependence of the output current $I_{REF}$ can be improved by using the offset voltage $\beta$ included in the added bias voltage $V_{SR}$. As indicated by the Equation (5), the drain-source voltage $V_{DSR}$ of the MOS transistor MR is determined by the temperature coefficient $\alpha$ and the offset voltage $\beta$. Therefore, the reference current source circuit 1 of FIG. 1 is characterized in that the added bias generator circuit 10 for introducing the offset voltage $\beta$ into the drain-source voltage $V_{DSR}$ is inserted.

Figure 3:
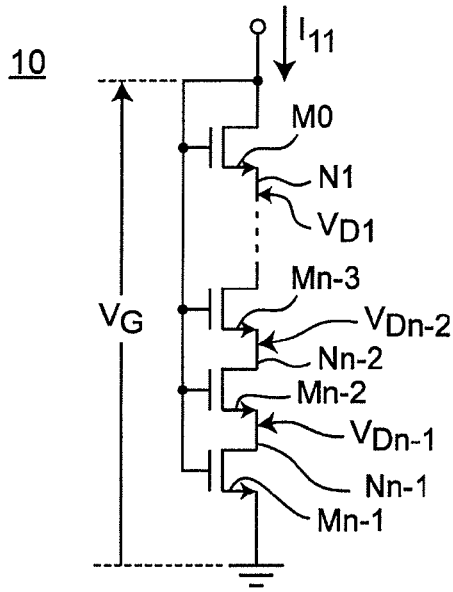
FIG. 3 is a circuit diagram showing a configuration of an added bias generator circuit 10 of FIG. 1.

FIG. 3 is a circuit diagram showing a configuration of the added bias generator circuit 10 of FIG. 1. As shown in FIG. 3, the added bias generator circuit 10 is configured to include a plurality n of nMOS transistors Mi (i=0, 1, . . . , n−1; n is equal to or larger than 2). A drain of the nMOS transistor M0 is connected to the drain of the pMOS transistor MP11. A source of the nMOS transistor M0 is connected to a drain of the nMOS transistor M1 via a tap (also referred to as a connection point) N1, and a source of the nMOS transistor M1 is connected to a drain of the nMOS transistor M2 via a tap N2. In a manner similar to above, sources of the nMOS transistors Mj (j=2, 3, . . . , n−2) are connected to drains of the nMOS transistors Mj+1 via taps Nj+1, respectively. A source of the nMOS transistor Mn−1 is grounded. Each of gates of the nMOS transistors Mi (i=0, 1, . . . , n−1) is connected to the drain of the nMOS transistor M0. In this case, voltages at the taps Ni (i=1, 2, . . . , n−1) are referred to as intermediate voltages $V_{Di}$ (i=1, 2, . . . , n−1). In addition, the n nMOS transistors Mi (i=0, 1, . . . , n−1) constitute a MOS transistor ladder circuit.

In the added bias generator circuit 10 of FIG. 3, the diode-connected nMOS transistor M0 operates in the subthreshold saturation region based on the minute current $I_{11}$, and the nMOS transistors Mi (i=1, 2, . . . , n−1) other than the nMOS transistor M0 operate in the subthreshold linear region based on the minute current $I_{11}$. The minute current $I_{11}$ corresponding to the output current $I_{REF}$ flows through the added bias voltage generator circuit 10, which includes one current path, to induce intermediate voltages $V_{Di}$ (i=1, 2, . . . , n−1) at the tap Ni (i=1, 2, . . . , n−1), respectively. One intermediate voltage is selected from the intermediate voltages $V_{Di}$ (i=1, 2, . . . , n−1) so that the output current $I_{REF}$ becomes constant against temperature changes, and a selected intermediate voltage is applied to the current control terminal N as the added bias voltage $V_{SR}$. Therefore, the inclination of the temperature characteristic $TC_I$ of the output current $I_{REF}$ can be controlled to be zero at the room temperature by appropriately designing the nMOS transistors Mi (i=0, 1, . . . , n−1) in the added bias generator circuit 10.

As described above, according to the first preferred embodiment, the added bias generator circuit 10 applies the added bias voltage $V_{SR}$ to the current control terminal N. Therefore, the inclination of the temperature characteristic $TC_I$ of the output current $I_{REF}$ can be controlled to be zero at the room temperature, and the reference current source circuit 1 can stably supply the constant output current $I_{REF}$ against the PVT variations. In addition, since the added bias generator circuit 10 has one current path, the reference current source circuit 1 can be configured to have a circuit area equal to or smaller than half of that of the prior art current source circuit, and the power consumption can be reduced.

Figure 4:
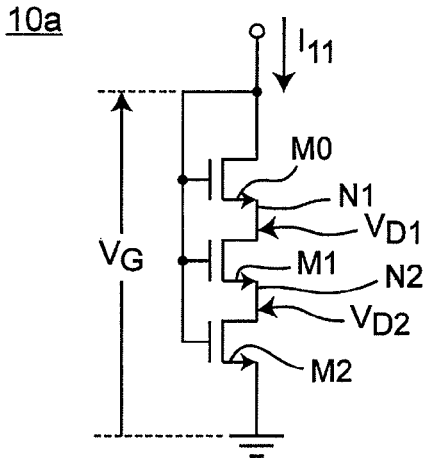
FIG. 4 is a circuit diagram showing a configuration of an added bias generator circuit 10*a* having three nMOS transistors M0, M1 and M2.

FIG. 4 is a circuit diagram showing a configuration of an added bias generator circuit 10*a* having three nMOS transistors M0, M1 and M2. The added bias generator circuit 10*a* is a circuit, in which n representing the number of nMOS transistors is three in the added bias generator circuit 10 described above. The added bias generator circuit 10*a* has action and advantageous effects similar to those in the case described above.

Figure 5:
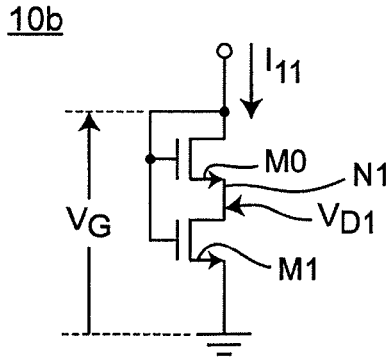
FIG. 5 is a circuit diagram showing a configuration of an added bias generator circuit 10*b* having two nMOS transistors M0 and M1.

FIG. 5 is a circuit diagram showing a configuration of an added bias generator circuit 10*b* having two nMOS transistors M0 and M1. The added bias generator circuit 10*b* is a circuit, in which n representing the number of nMOS transistors is two. The added bias generator circuit 10*b* has action and advantageous effects similar to those in the case described above.

Second Preferred Embodiment

Figure 7:
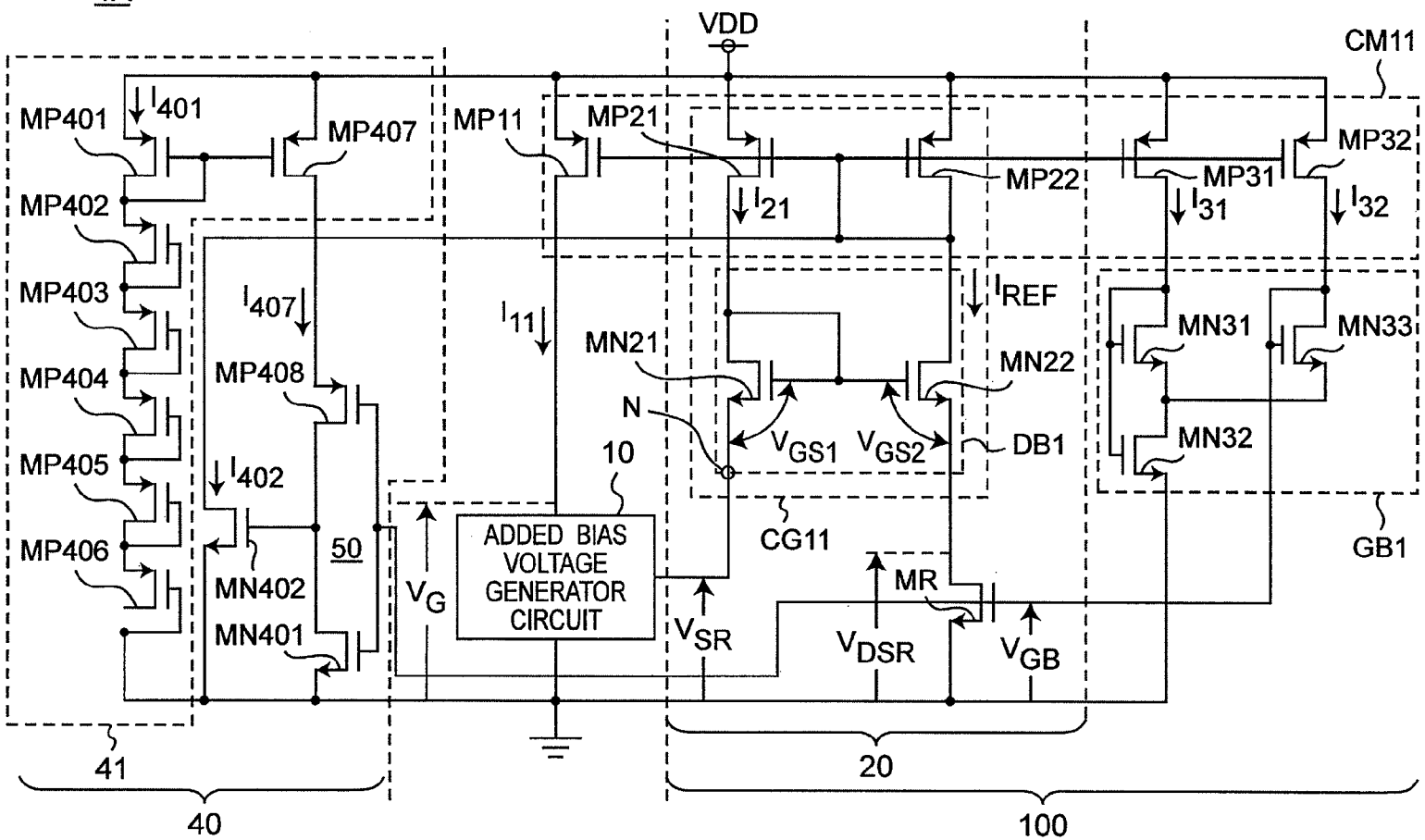
FIG. 7 is a circuit diagram showing a configuration of a reference current source circuit 1A according to a second preferred embodiment of the present invention.

FIG. 7 is a circuit diagram showing a configuration of a reference current source circuit 1A according to the second preferred embodiment of the present invention. The reference current source circuit 1A is characterized in that a startup circuit 40 is further provided as compared with the reference current source circuit 1 of FIG. 1. The other components are similar to those of the reference current source circuit 1, and therefore, no description is provided for them.

The reason why the startup circuit 40 is provided is as follows. In the reference current source circuit 1, it is possibly a case where all of the gate voltages of the nMOS transistors are 0 V, and all of the gates of the pMOS transistors have voltages generated by the power source VDD. In this case, no operating current flows through the reference current source circuit 1, and the reference current source circuit 1 does not operate. This state in which the reference current source circuit 1 does not operate is referred to as a non-operating time or a zero-current state of the reference current source circuit 1 hereinafter. The startup circuit 40 is used for avoiding the zero-current state.

Referring to FIG. 7, the startup circuit 40 is configured to include a current supply circuit 41, a pMOS transistor MP408 and an nMOS transistor MN401 that constitute an inverter 50, and an nMOS transistor MN402 that pulls out and flows an operating current. In addition, the current supply circuit 41 is configured to include multi-stage diode-connected pMOS transistors MP401 to MP406, and a pMOS transistor MP407 that constitutes a current mirror circuit. In this case, the startup circuit 40 operates only in the zero-current state, and does not operate when the reference current source circuit 1A operates at a normal operating point.

In the startup circuit 40, the inverter 50 monitors the gate bias voltage $V_{GB}$ of the MOS transistor MR, and detects the non-operating time of the reference current source circuit 1A. Namely, the inverter 50 is a detector circuit for detecting the non-operating time of the current source circuit 20. When the gate bias voltage $V_{GB}$ of the MOS transistor MR is 0 V (at the non-operating time), the output signal of the inverter 50 becomes a high-level, and a high-level signal is applied to a gate of the nMOS transistor MN402 to turn on the nMOS transistor MN402. By this operation, the nMOS transistor MN402 pulls out a current $I_{402}$ from the pMOS transistor MP22, and this becomes the startup current of the reference current source circuit 1A to start up and stably operate the reference current source circuit 1A. Namely, the nMOS transistor MN402 is a startup transistor circuit for starting up the reference current source circuit 1A by flowing a predetermined startup current $I_{402}$ through the reference current source circuit 1A when the non-operating time of the reference current source circuit 1A is detected by the inverter 50. On the other hand, when the gate bias voltage $V_{GB}$ monitored by the inverter 50 is the operating voltage, the output signal of the inverter 50 becomes low level (0 V), and a low-level signal is applied to the gate of the nMOS transistor MN402 to leave the nMOS transistor MN402 in its off state. Therefore, the nMOS transistor MN402 flows no startup current through the reference current source circuit 1A. Namely, the startup circuit 40 does not influence any operation of the reference current source circuit 1A in the normal operation.

It is noted that a constant minute current $I_{401}$ is generated by the multi-stage diode-connected pMOS transistors MP401 to MP406, and the pMOS transistor MP407 of the current mirror circuit supplies a minute current $I_{407}$ corresponding to the above constant minute current to the inverter 50 as a bias operating current, so as to control a current flowing through the inverter 50 not to increase for the reduction of the power consumption. Namely, the current supply circuit 41 is configured to include a minute current generator circuit, which includes the pMOS transistors MP401 to MP406 and generates the predetermined minute current $I_{401}$ from the power supply voltage from the power source VDD, and the pMOS transistor MP407 which constitutes a current mirror circuit for generating the minute current $I_{407}$ corresponding to the minute current generated by the minute current generator circuit as the bias operating current.

As described above, the second preferred embodiment has action and advantageous effects similar to those of the first preferred embodiment. In addition, since the reference current source circuit 1A is configured to include the startup circuit 40, the reference current source circuit 1A operates at the normal operating point.

Third Preferred Embodiment

Figure 8:
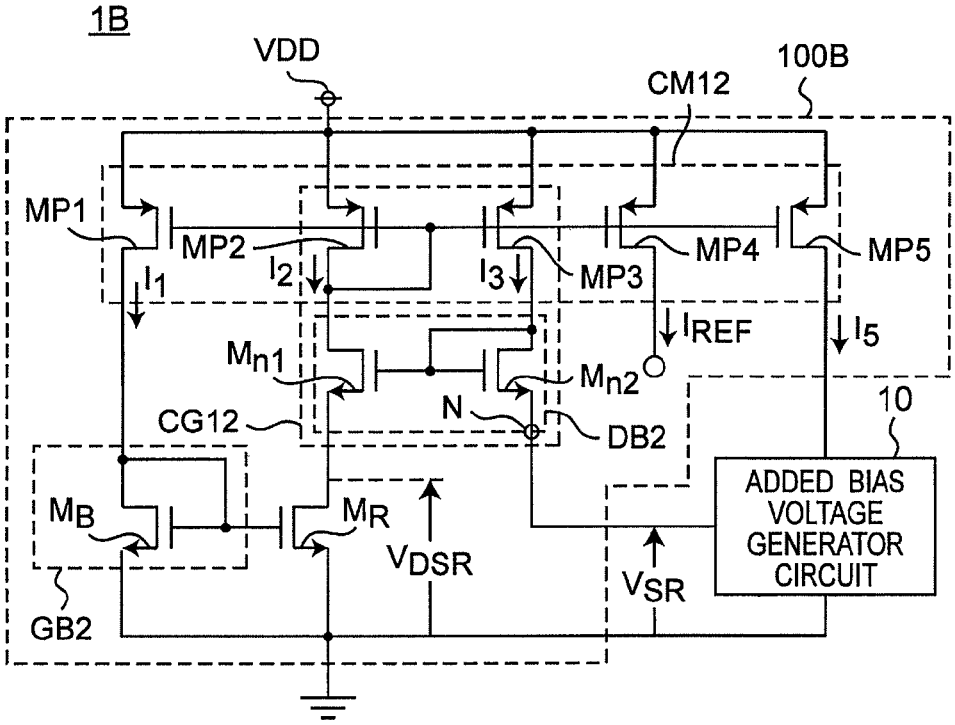
FIG. 8 is a circuit diagram showing a configuration of a reference current source circuit 1B according to a third preferred embodiment of the present invention.

FIG. 8 is a circuit diagram showing a configuration of a reference current source circuit 1B according to the third preferred embodiment of the present invention. The reference current source circuit 1B of FIG. 8 is characterized in that an added bias generator circuit 10 is further provided with a reference current source circuit 100B disclosed in the Non-Patent Document 7. In this case, the added bias generator circuit 10 of FIG. 8 has a configuration similar to that of the added bias generator circuit 10 as described in the first preferred embodiment, and operates in a manner similar to above.

Referring to FIG. 8, the reference current source circuit 1B is configured to include the reference current source circuit 100B and the added bias generator circuit 10. Further, the reference current source circuit 100B is configured to include a MOS transistor $M_R$, a current mirror circuit CM12 including pMOS transistors MP1, MP2, MP3, MP4 and MP5, a gate bias voltage generator circuit GB2 including a nMOS transistor $M_B$, and a drain bias voltage generator circuit DB2 including nMOS transistor $M_{n1}$ and $M_{n2}$. Currents $I_1$, $I_3$, $I_{REF}$ and $I_5$ each corresponding to a current $I_2$ flowing through the pMOS transistor MP2 flows through the pMOS transistors MP1, MP3, MP4 and MP5, respectively. The added bias voltage generator circuit 10 generates the added bias voltage $V_{SR}$ based on the minute current $I_5$, and applies the added bias voltage $V_{SR}$ to a current control terminal N, which is a source of the nMOS transistor $M_{n2}$. In addition, the pMOS transistors MP2 and MP3 and the nMOS transistor $M_{n1}$ and $M_{n2}$ constitute a minute current generator circuit CG12, and the minute current $I_{REF}$ corresponding to the current $I_2$ flowing through the pMOS transistor MP2 and the nMOS transistor $M_{n1}$ flows through the pMOS transistor MP3 and the nMOS transistor $M_{n2}$.

The reference current source circuit of the Non-Patent Document 7 has a configuration in which the added bias generator circuit 10 of the reference current source circuit 1B of FIG. 8 is not provided, and in which the source of the nMOS transistor $M_{n2}$ is grounded. In addition, the MOS transistor $M_R$ is used in the reference current source circuit of the Non-Patent Document 7. The output current $I_{REF}$ flowing through the reference current source circuit of the Non-Patent Document 7 is determined by the drain-source voltage $V_{DSR}$ of the MOS transistor $M_R$. In the reference current source circuit of the Non-Patent Document 7, a terminal having action and advantageous effects similar to those of the current control terminal N in the above-described reference current source circuit 1 is the source of the nMOS transistor $M_{n2}$. In the reference current source circuit 1B of FIG. 8, the added bias voltage $V_{SR}$ generated by the added bias generator circuit 10 is added to a drain bias voltage generated by the drain bias voltage generator DB2, and a voltage of the adding results is applied to the drain of the MOS transistor $M_R$. Therefore, the temperature characteristic $TC_I$ of the output current $I_{REF}$ can be controlled. As described above, the third preferred embodiment has action and advantageous effects similar to those of the first preferred embodiment.

The reference current source circuit 1B of the third preferred embodiment is not configured to include the startup circuit 40 described in the second preferred embodiment, however, the present invention is not limited to this. The reference current source circuit 1B may be configured to further include the startup circuit 40 in a manner similar to that of the second preferred embodiment.

Fourth Preferred Embodiment

Figure 9:
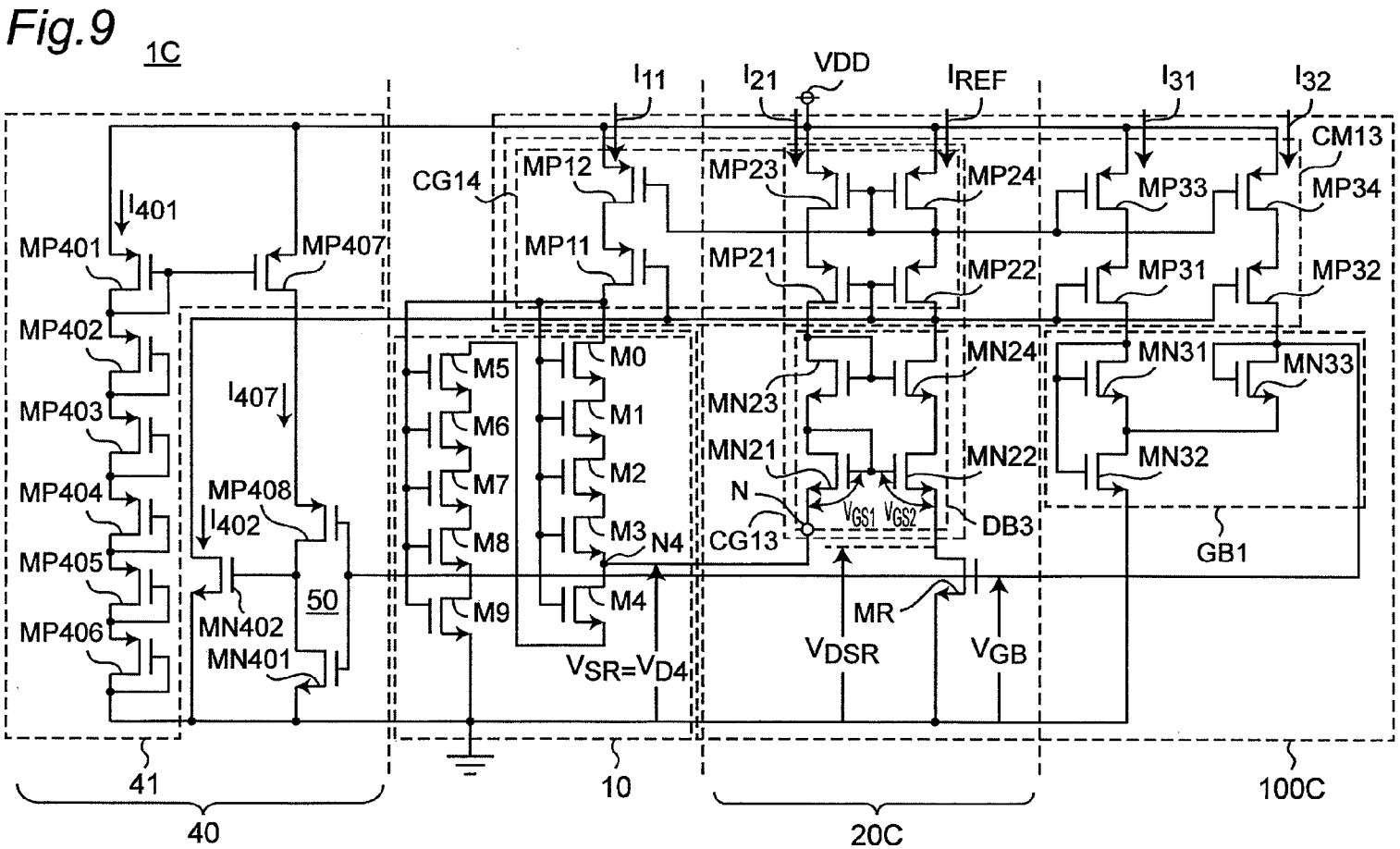
FIG. 9 is a circuit diagram showing a configuration of a reference current source circuit 1C according to a fourth preferred embodiment of the present invention.

FIG. 9 is a circuit diagram showing a configuration of a reference current source circuit 1C according to the fourth preferred embodiment of the present invention. The reference current source circuit 1C is characterized in that a current mirror circuit CM13 is provided in place of the current mirror circuit CM11, and a drain bias voltage generator circuit DB3 is provided in place of the drain bias voltage generator circuit DB1 as compared with the reference current source circuit 1A of FIG. 7. The other components are similar to those of the reference current source circuit 1A of FIG. 7. In the present preferred embodiment, the added bias voltage generator circuit 10 has such a configuration that the number n of the nMOS transistors is set to 10 and a terminal for outputting the added bias voltage $V_{SR}$ is set to the tap N4 in FIG. 3.

Referring to FIG. 9, the reference current source circuit 1C is configured to include a current source circuit 100C, the added bias voltage generator circuit 10, and the startup circuit 40. In addition, the current source circuit 100C is configured to include the current mirror circuit CM13, the MOS transistor MR, the gate bias voltage generator circuit GB1, and the drain bias voltage generator circuit DB3.

Referring to FIG. 9, the current mirror circuit CM13 is configured to include the pMOS transistors MP11, MP21, MP22, MP31 and MP32 and pMOS transistors MP12, MP23, MP24, MP33 and MP34. In this case, each of pairs of the pMOS transistors MP11 and MP12, the pMOS transistors MP21 and MP23, the pMOS transistors MP31 and MP33, and the pMOS transistors MP32 and MP34 constitutes a cascode current mirror circuit. In addition, the drain bias voltage generator circuit DB3 is a cascode current mirror circuit, and is configured to include nMOS transistors MN21, MN22, MN23 and MN24.

The current mirror circuit CM13 generates the minute currents $I_{11}$, $I_{21}$, $I_{REF}$, $I_{31}$ and $I_{32}$ each corresponding to the output current $I_{REF}$ flowing through the pMOS transistors MP22 and MP24. The minute current $I_{11}$ flows through the pMOS transistors MP12 and MP11, and is outputted to the drain of the nMOS transistor M0. In addition, the minute current $I_{21}$ flows through the pMOS transistors MP23 and MP21, and is outputted to a drain of the nMOS transistor MN23. Further, the output current $I_{REF}$ flows through the pMOS transistors MP24 and MP22, and is outputted to a drain of the nMOS transistor MN24. Still further, the minute current $I_{31}$ flows through the pMOS transistors MP33 and MP31, and is outputted to the drain of the nMOS transistor MN31. The minute current $I_{32}$ flows through the pMOS transistors MP34 and MP32, and is outputted to the drain of the nMOS transistor MN33.

In the current mirror circuit CM13, the pMOS transistor MP11, MP12 and MP21 to MP24 constitute a minute current generator circuit CG14, and the minute current $I_{11}$, which corresponds to the output current $I_{REF}$ flowing through the pMOS transistors MP24 and MP22, flows through the pMOS transistors MP12 and MP11. In the drain bias voltage generator circuit DB3, a minute current, which corresponds to a current flowing through the nMOS transistors MN23 and MN21, flows through the nMOS transistors MN22 and MN24. Further, the pMOS transistors MP21 to MP24 and the nMOS transistors MN21 to MN24 constitute a minute current generator circuit CG13. A minute current, which corresponds to a current flowing through the pMOS transistors MP24 and MP22 and the nMOS transistors MN24 and MN22, flows through the pMOS transistors MP23 and MP21 and the nMOS transistors MN23 and MN21. Referring to FIG. 9, each of the nMOS transistors MN21 to MN24 and MN31 to MN33 operates in the subthreshold saturation region.

Referring to FIG. 9, the added bias generator circuit 10 is configured to include a MOS transistor ladder circuit configured to include the nMOS transistors M0 to M9, and has such a configuration that the number n of the nMOS transistors is set to 10 and a terminal for outputting the added bias voltage $V_{SR}$ is set to the tap N4 in FIG. 3. Namely, the tap N4, which is a connection point between the source of the nMOS transistor M3 and the drain of the nMOS transistor M4, is connected to the source of the nMOS transistor MN21 via the current control terminal N. Referring to FIG. 9, the added bias voltage generator circuit 10 generates the added bias voltage $V_{SR}$, which has the predetermined temperature coefficient γ and includes the predetermined offset voltage β, based on the minute current $I_{11}$, so that the output current $I_{REF}$ becomes constant against the temperature changes. In the following descriptions, taps Ni (i=1, 2, . . . , 9) and intermediate voltages $V_{Di}$ (i=1, 2, . . . , 9) are similar to those described with reference to FIG. 3.

In the drain bias voltage generator circuit DB3 of FIG. 9, the nMOS transistors MN21 to MN24 operate in the subthreshold saturation region based on the minute currents $I_{REF}$ and $I_{21}$. The drain bias voltage generator circuit DB3 generates a voltage ($V_{GS1}-V_{GS2}$) based on the minute currents $I_{REF}$ and $I_{21}$, adds the added bias voltage $V_{SR}$ to the voltage ($V_{GS1}-V_{GS2}$), and applies a voltage ($V_{SR}+V_{GS1}-V_{GS2}$) of the adding results to the drain of the MOS transistor MR as the drain bias voltage $V_{DSR}$. In addition, referring to FIG. 9, the gate bias voltage generator circuit GB1 generates the gate bias voltage $V_{GB}$ in a manner similar to that of the first preferred embodiment, and applies the gate bias voltage $V_{GB}$ to the gate of the MOS transistor MR.

It is noted that the minute current generator circuit CG13 and the MOS transistor MR constitute a current generator circuit 20C.

As described above, in the reference current source circuit 1C of the present preferred embodiment, the current mirror circuit CM13 and the drain bias voltage generator circuit DB3 are configured to include the cascode current mirror circuits. Therefore, the reference current source circuit 1C operates more stably than the reference current source circuit 1A against fluctuations in the power supply voltage.

Here is provided a discussion about the temperature characteristic of the intermediate voltage $V_{Di}$ (i=1, 2, . . . , n−1) in the MOS transistor ladder circuit configured to include n nMOS transistors Mi (i=0, 1, . . . , n−1) with reference to FIG. 3. In this case, in order to simplify the analysis, here is provided a discussion about the MOS transistor ladder circuit configured to include three nMOS transistors M0, M1 and M2 as shown in FIG. 4.

In this case, it is assumed that a current I (=$I_{11}$) flows through the MOS transistor ladder circuit of FIG. 4. Since the nMOS transistor M0 operates in the subthreshold saturation region, and the nMOS transistors M1 and M2 operate in the subthreshold linear region, the nMOS transistors M0, M1 and M2 satisfy the following Equations (7), (8) and (9), respectively, based on the Equation (1) and the Equation (2):

$$I = K_0 I_0 \exp\left(\frac{V_G - V_{D1} - V_{TH}}{\eta V_T}\right), \tag{7}$$

$$I = K I_0 \exp\left(\frac{V_G - V_{D2} - V_{TH}}{\eta V_T}\right)\left(1 - \exp\left(-\frac{V_{D1} - V_{D2}}{V_T}\right)\right), \text{ and} \tag{8}$$

$$I = K I_0 \exp\left(\frac{V_G - V_{TH}}{\eta V_T}\right)\left(1 - \exp\left(-\frac{V_{D2}}{V_T}\right)\right), \tag{9}$$

where, $K_0$ denotes an aspect ratio of the nMOS transistor M0, $V_G$ denotes a gate voltage of the nMOS transistors M0, M1 and M2, and K denotes an aspect ratio of the nMOS transistors M1 and M2.

By transforming the Equations (7), (8) and (9), the intermediate voltages $V_{D1}$ and $V_{D2}$ are expressed by the Equations (10) and (11), respectively:

$$V_{D1} = \left(2 + \frac{I}{\eta K I_0}\right)\frac{\eta^2 K I_0 V_T I}{(\eta K I_0 + I)^2}\left(1 + \ln\left(\frac{K_0 I_0}{I}\right)\right), \text{ and} \quad (10)$$

$$V_{D2} = \frac{\eta^2 K I_0 V_T I}{(\eta K I_0 + I)^2}\left(1 + \ln\left(\frac{K_0 I_0}{I}\right)\right). \quad (11)$$

Since the Equations (10) and (11) do not include the threshold voltage $V_{TH}$, the intermediate voltages $V_{D1}$ and $V_{D2}$ have tolerances against threshold voltage fluctuations.

Figure 6:
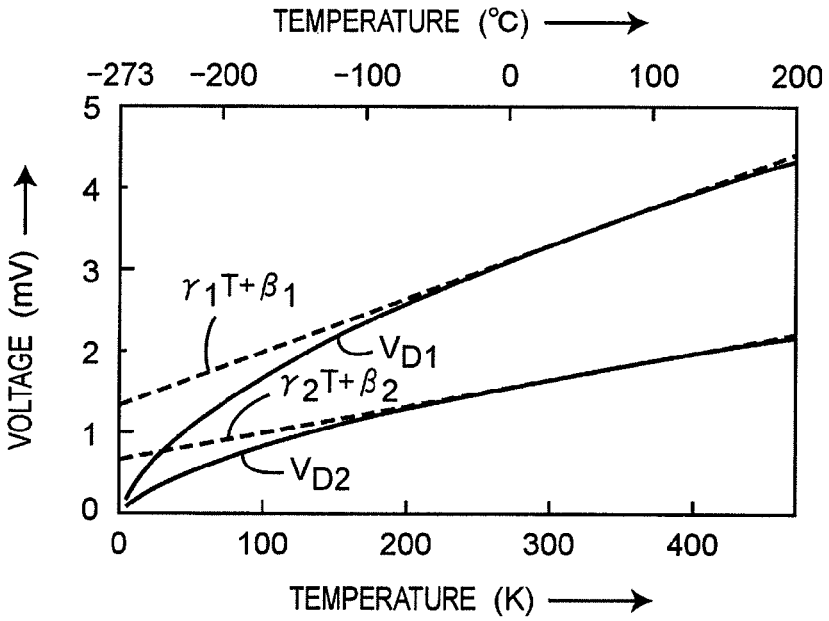
FIG. 6 is a graph showing numerical calculation results and approximated linear lines of an intermediate voltage $V_{D1}$ at a tap N1 and an intermediate voltage $V_{D2}$ at a tap N2 of FIG. 4 with respect to the temperature.

FIG. 6 is a graph showing numerical calculation results and approximated linear lines of the intermediate voltage $V_{D1}$ at the tap N1 and the intermediate voltage $V_{D2}$ at the tap N2 of FIG. 4 with respect to the temperature. The horizontal axis represents temperatures in the absolute temperature (Kelvin) and the Celsius scales. Referring to FIG. 6, the solid lines represent the numerical calculation results of the intermediate voltages $V_{D1}$ and $V_{D2}$, and the dashed lines represent the approximated linear lines with respect to the intermediate voltages $V_{D1}$ and $V_{D2}$. The value of the current I was set to 100 nA. It can be understood from FIG. 6 that the intermediate voltages $V_{D1}$ and $V_{D2}$ nonlinearly increase with respect to the temperature. On the other hand, when the intermediate voltages $V_{D1}$ and $V_{D2}$ are approximated by straight lines, respectively, in a temperature range of −20° C. (253K) to 100° C. (373K), the approximated linear lines shown by the dashed lines are obtained. These approximated linear lines indicate that the intermediate voltages $V_{D1}$ and $V_{D2}$ expressed by the Equations (10) and (11), respectively, behave as voltages that depend on the temperature and have offset voltages $\beta_1$ and $\beta_2$ at the absolute zero temperature. Therefore, the Equations (10) and (11) can be approximated to the Equations (12) and (13), respectively:

$$V_{D1}=\gamma_1 T+\beta_1 \quad (12), \text{ and}$$

$$V_{D2}=\gamma_2 T+\beta_2 \quad (13),$$

where $\gamma_1$ and $\gamma_2$ are referred to as temperature coefficients of the intermediate voltages.

Therefore, it is possible to handle the intermediate voltages $V_{D1}$ and $V_{D2}$ of the MOS transistor ladder circuit of FIG. 4 as voltages that have the offset voltages $\beta_1$ and $\beta_2$, respectively.

In addition, the intermediate voltage $V_{Di}$ (i=1, 2, . . . , n−1) at the tap Ni (i=1, 2, . . . , n−1) in the MOS transistor ladder circuit of FIG. 3 is also expressed in a manner similar to that of the MOS transistor ladder circuit of FIG. 4 described above, and it is possible to handle the intermediate voltage $V_{Di}$ (i=1, 2, . . . , n−1) as a voltage having an offset voltage βi (i=1, 2, . . . , n−1). Further, the intermediate voltage $V_{D1}$ at the tap N1 in the MOS transistor ladder circuit, which includes the two nMOS transistors M0 and M1 shown in FIG. 5, is also expressed in a manner similar to that of the MOS transistor ladder circuit of FIG. 4 described above, and it is possible to handle the intermediate voltage $V_{D1}$ as a voltage having the offset voltage $\beta_1$.

Table 1 shows SPICE simulation results of the temperature coefficient γ of the intermediate voltage and the offset voltage β obtained at several taps by changing the number of nMOS transistors that constitute the MOS transistor ladder circuit of FIG. 3 when the current flowing through the MOS transistor ladder circuit of FIG. 3 is set to 100 nA. As shown in Table 1, the value of the temperature coefficient γ of the intermediate voltage and the value of the offset voltage β can be set according to the number of nMOS transistors and the tap positions. In other words, by setting circuit parameters, the value of the temperature coefficient γ and the value of the offset voltage β can be determined.

TABLE 1

| Number of Transistors n | Tap Position | Temperature Coefficient γ (μV/K) | Offset Voltage β (mV) |
|---|---|---|---|
| 10 | N5 | 80.4 | 7.72 |
| | N6 | 105 | 10.1 |
| | N7 | 137 | 13.2 |
| | N8 | 185 | 17.9 |
| 9 | N6 | 125 | 11.9 |
| 11 | N6 | 92.2 | 8.85 |

For example, the MOS transistor ladder circuit of FIG. 3 can output the added bias voltage $V_{SR}$ that has a variety of temperature coefficients γ and a variety of offset voltages β by changing the number of nMOS transistors or the tap Ni (i=1, 2, . . . , n−1) used as an output terminal. In addition, the MOS transistor ladder circuit of FIG. 3 can output the added bias voltage $V_{SR}$ having a variety of temperature coefficients γ and a variety of offset voltages β also by changing the aspect ratio of the nMOS transistor Mi (i=0, 1, . . . , n−1). Further, the MOS transistor ladder circuit of FIG. 4 can output the added bias voltage $V_{SR}$ that has a variety of temperature coefficients γ and a variety of offset voltages β by changing the taps N1 and N2 used as the output terminal. In addition, the MOS transistor ladder circuit of FIG. 4 can output the added bias voltage $V_{SR}$ that has a variety of temperature coefficients γ and a variety of offset voltages β by changing the aspect ratios of the nMOS transistors M0, M1 and M2. Further, the MOS transistor ladder circuit of FIG. 5 can output the added bias voltage $V_{SR}$ that has a variety of temperature coefficients γ and a variety of offset voltages β by changing the aspect ratios of the nMOS transistors M0 and M1.

As described above, the MOS transistor ladder circuit can output the added bias voltage $V_{SR}$ having a variety of temperature coefficients γ and a variety of offset voltages β, and therefore, the added bias voltage $V_{SR}$ generated by the added bias generator circuit 10C is generally expressed by the Equation (14):

$$V_{SR}=\gamma T+\beta \quad (14).$$

Therefore, the drain-source voltage $V_{DSR}$ of the MOS transistor MR is expressed by the Equation (15):

$$\begin{aligned} V_{DSR} &= V_{SR} + V_{GS1} - V_{GS2} \\ &= V_{SR} + \eta V_T \ln\left(\frac{K_2}{K_1}\right) \\ &= \gamma T + \beta + \eta V_T \ln\left(\frac{K_2}{K_1}\right) \\ &= \alpha T + \beta, \end{aligned} \quad (15)$$

where $V_{GS1}$ denotes the gate-source voltage of the nMOS transistor MN21, $V_{GS2}$ denotes the gate-source voltage of the nMOS transistor MN22, $K_1$ denotes an aspect ratio of the nMOS transistor MN21, $K_2$ denotes an aspect ratio of the nMOS transistor MN22, and α is expressed by the following Equation (16):

$$\alpha = \gamma + \eta\frac{k_B}{q}\ln\left(\frac{K_2}{K_1}\right). \quad (16)$$

According to the Equations (6) and (14) to (16), the inclination of the temperature characteristic $TC_I$ of the output current $I_{REF}$ can be set to become zero at the room temperature by adjusting the value of the temperature coefficient γ and the value of the offset voltage β of the added bias voltage $V_{SR}$ generated by the added bias generator circuit 10C and the aspect ratios of the nMOS transistors MN21 and MN22.

As described above, according to the fourth preferred embodiment, the added bias generator circuit 10 generates the added bias voltage $V_{SR}$ that has the temperature coefficient γ and includes the offset voltage β, and applies the added bias voltage $V_{SR}$ to the current control terminal N. Therefore, the inclination of the temperature characteristic $TC_I$ of the output current $I_{REF}$ can be controlled to be zero at the room temperature, and the reference current source circuit 1C can stably supply the constant output current $I_{REF}$ against the PVT variations. In addition, since the added bias generator circuit 10 has one current path, the reference current source circuit 1C can be configured to have a circuit area equal to or smaller than half of that of the prior art current source circuit, and the power consumption can be reduced.

In the fourth preferred embodiment, the MOS transistor ladder circuit is configured to include ten nMOS transistors, and the tap N4 is connected to the current control terminal N, however, the present invention is not limited to this. The MOS transistor ladder circuit may be configured to include two or more arbitrary number of nMOS transistors, and a tap other than the tap N4 may be connected to the current control terminal N.

Fifth Preferred Embodiment

Figure 10:
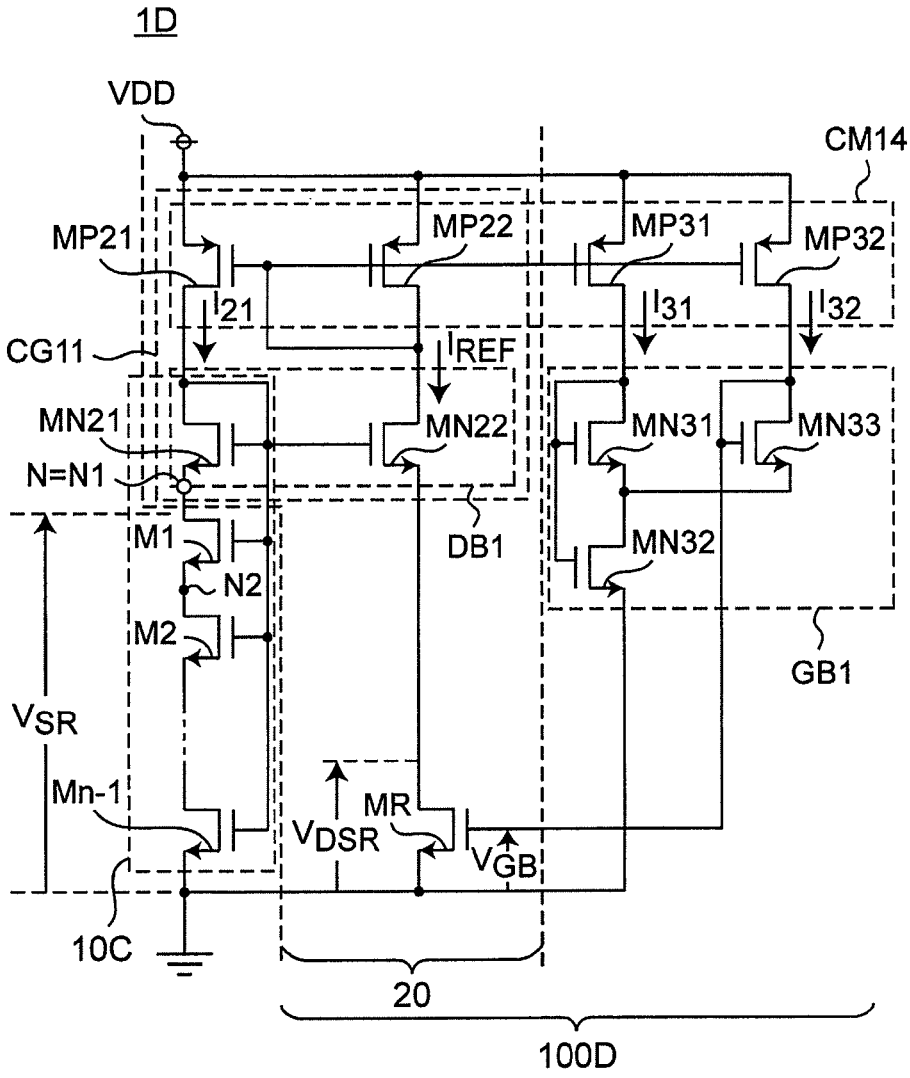
FIG. 10 is a circuit diagram showing a configuration of a reference current source circuit 1D according to a fifth preferred embodiment of the present invention.

FIG. 10 is a circuit diagram showing a configuration of a reference current source circuit 1D according to the fifth preferred embodiment of the present invention. The reference current source circuit 1D is characterized in that only one common nMOS transistor is used instead of the nMOS transistor M0 of an added bias voltage generator circuit 10C and the nMOS transistor MN21 of the drain bias voltage generator circuit DB1. The other components are similar to those of the reference current source circuit 1, and therefore, no description is provided therefor.

Referring to FIG. 10, the reference current source circuit 1D is configured to include a current source circuit 100D and the added bias voltage generator circuit 10C. In addition, the current source circuit 100D is configured to include a current mirror circuit CM14, the MOS transistor MR, the gate bias voltage generator circuit GB1 and the drain bias voltage generator circuit DB1. In this case, the current mirror circuit CM14 has such a configuration that the pMOS transistor MP11 is removed from the current mirror circuit CM11 of FIG. 1, and generates the minute currents $I_{21}$, $I_{REF}$, $I_{31}$ and $I_{32}$ in a manner similar to that of the current mirror circuit CM11. In addition, each of the gate bias voltage generator circuit GB1 and the drain bias voltage generator circuit DB1 operates in a manner similar to that of the first preferred embodiment.

Referring to FIG. 10, the added bias generator circuit 10C is configured to include the nMOS transistor MN21 operating in the subthreshold saturation region and n−1 (n is an integer equal to or larger than two) nMOS transistors Mi (i=1, 2, . . . , n−1) each operating in the subthreshold linear region. In the added bias generator circuit 10C, the nMOS transistors Mi (i=1, 2, . . . , n−1) are connected in series with each other between the current control terminal N and the ground, and each of gates of the nMOS transistors Mi (i=1, 2, . . . , n−1) is connected to the gate of the nMOS transistor MN21. The added bias generator circuit 10C has a configuration similar to that of the added bias generator circuit 10 described above with reference to FIG. 3, and the nMOS transistor MN21 that operates in the subthreshold saturation region in FIG. 10 operates in a manner similar to that of the nMOS transistor M0 that operates in the subthreshold saturation region in FIG. 3. The minute current $I_{21}$ corresponding to the output current $I_{REF}$ flows through the added bias generator circuit 10C, and the added bias voltage $V_{SR}$ is induced at the current control terminal N. Therefore, the inclination of the temperature characteristic $TC_I$ of the output current $I_{REF}$ can be controlled to be zero at the room temperature by appropriately designing the nMOS transistor Mi (i=1, 2, . . . , n−1) in the added bias generator circuit 100C.

As described above, the fifth preferred embodiment has action and advantageous effects similar to those of the first preferred embodiment. In addition, by using only one common nMOS transistor instead of the nMOS transistor MN21 and the nMOS transistor M0 of the first preferred embodiment, the nMOS transistor M0 and the pMOS transistor MP11 can be removed. As a result, the number of transistors can be reduced as compared with that of the first preferred embodiment.

It should be noted that, in the reference current source circuit 1B of FIG. 8, one common nMOS transistor may be used instead of the nMOS transistor $M_{n2}$ and the nMOS transistor M0 of the added bias voltage generator circuit 10. In this case, it is possible to remove the nMOS transistor M0 and the pMOS transistor MP5.

Sixth Preferred Embodiment

Figure 11:
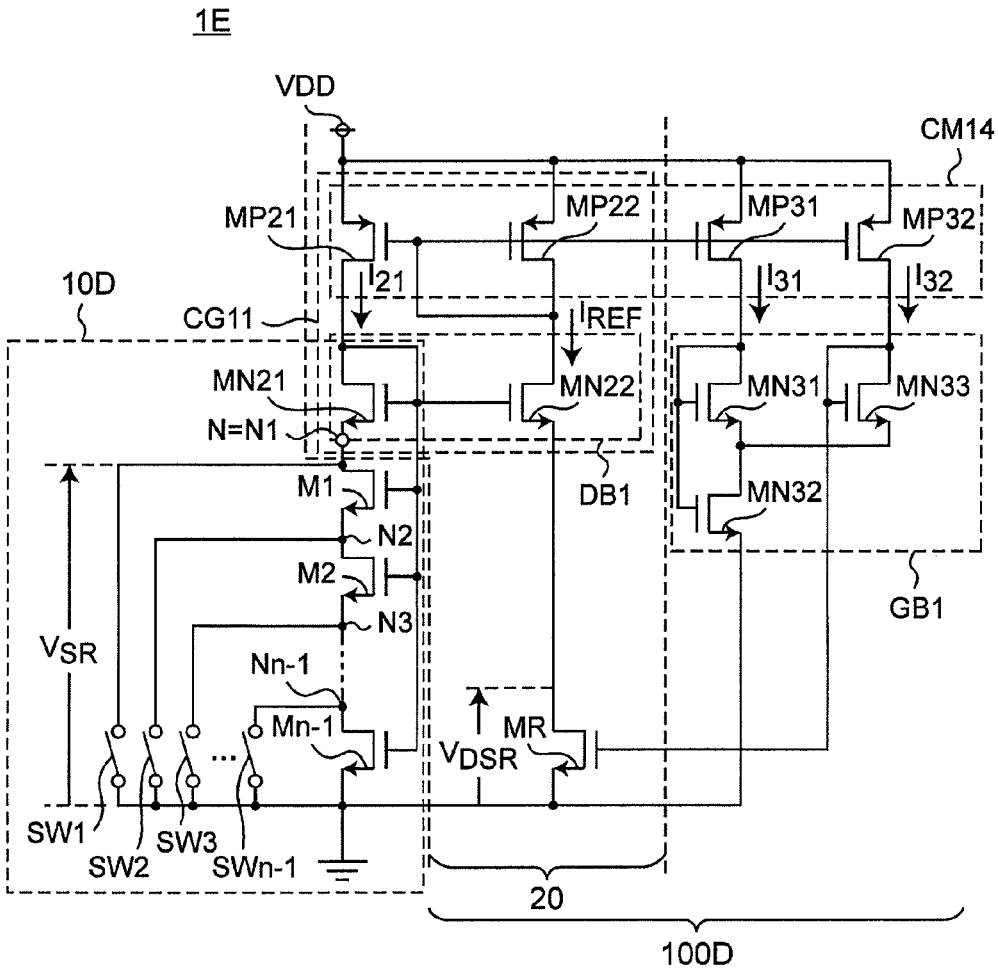
FIG. 11 is a circuit diagram showing a configuration of a reference current source circuit 1E according to a sixth preferred embodiment of the present invention.

FIG. 11 is a circuit diagram showing a configuration of a reference current source circuit 1E according to the sixth preferred embodiment of the present invention. The reference current source circuit 1E of FIG. 11 is characterized in that an added bias generator circuit 10D is provided in place of the added bias generator circuit 10C as compared with the reference current source circuit 1D of FIG. 10. The other components are similar to those of the reference current source circuit 1D, and therefore, no description is provided therefor.

Referring to FIG. 11, the added bias generator circuit 10D is characterized in that switches SWi (i=1, 2, . . . , n−1; n is an integer equal to or larger than 3) are further provided as compared with the added bias generator circuit 10C. The switches SWi (i=1, 2, . . . , n−1) are connected between the drains of the nMOS transistors Mi (i=1, 2, . . . , n−1; n is an integer equal to or larger than 3) and the ground, respectively. It is noted that each of the switches SWi (i=1, 2, . . . , n−1) may be configured to include a MOS transistor that is controlled to be turned on or off according to a control signal applied to a gate of the MOS transistor. The added bias generator circuit 10D configured as described above can change the number of stages of nMOS transistors that operate in the subthreshold linear region and constitute the added bias generator circuit 10D by turning on any one of the switches SWi (i=1, 2, . . . , n−1) and turning off the other switches. Therefore, it is possible to apply the added bias voltage $V_{SR}$ that has various values to the current control terminal N. Namely, the added bias voltage $V_{SR}$ is determined according to the number of stages of the turned-on nMOS transistors of the added bias generator circuit 10D. As described above, the sixth preferred embodiment has action and advantageous effects similar to those of the fifth preferred embodiment.

IMPLEMENTAL EXAMPLES

The present inventors manufactured a chip by way of trail by using a 0.35-μm, 2P-4M, CMOS process based on the reference current source circuit 1C of FIG. 9. A trial manufactured chip has a circuit area of 0.055 $mm^2$. The power supply voltage was set to 2.5 V. The measurement results of the trial production chip are described below.

Figure 12:
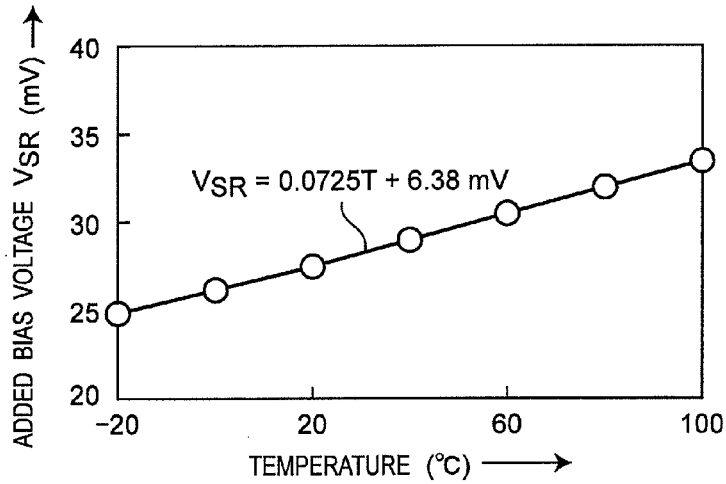
FIG. 12 is a graph showing an added bias voltage $V_{SR}$ of an added bias generator circuit 10 of FIG. 9 with respect to the temperature.

FIG. 12 is a graph showing the added bias voltage $V_{SR}$ of the added bias generator circuit 10 of FIG. 9 with respect to the temperature. In this case, the temperature was changed from −20° C. to 100° C. It can be confirmed that the added bias voltage $V_{SR}$ has a minute offset voltage, and rises following the rise of the temperature. An approximated linear function became $V_{SR}$=0.0725×T+6.38 mV, and it could be confirmed that the added bias generator circuit 10 outputted the added bias voltage $V_{SR}$ having an offset voltage of 6.38 mV.

Figure 13:
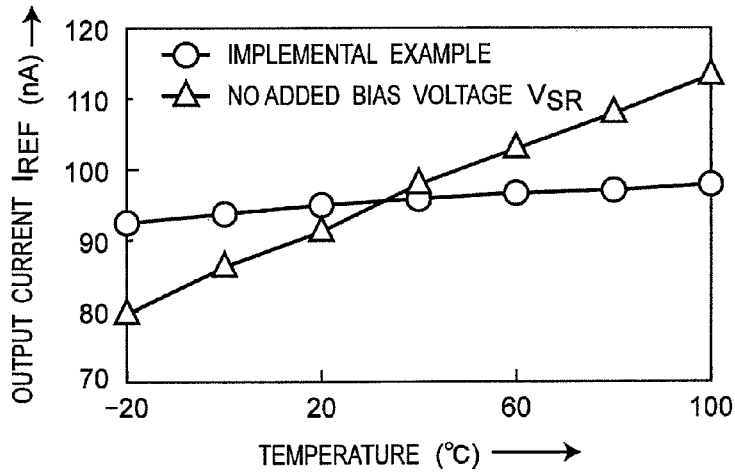
FIG. 13 is a graph showing output currents $I_{REF}$ generated by the reference current source circuit 1C of FIG. 9 and a prior art current source circuit with respect to the temperature.

FIG. 13 is a graph showing the output currents $I_{REF}$ generated by the reference current source circuit 1C of FIG. 9 and a prior art current source circuit with respect to the temperature. In this case, the temperature was changed from −20° C. to 100° C. It is noted that the prior art reference current source circuit has a configuration in which the added bias generator circuit 10 is removed from the reference current source circuit 1C, and the offset voltage β is zero. The output current $I_{REF}$ of the prior art reference current source circuit largely increases following the rise of the temperature. On the other hand, since the reference current source circuit 1C is configured to include the added bias generator circuit 10, the temperature dependence of the output current $I_{REF}$ generated by the reference current source circuit 1C is small. The average value of the output current $I_{REF}$ of the reference current source circuit 1C was 94.9 nA, and the temperature characteristic $TC_I$ was 523 ppm/° C.

Figure 14:
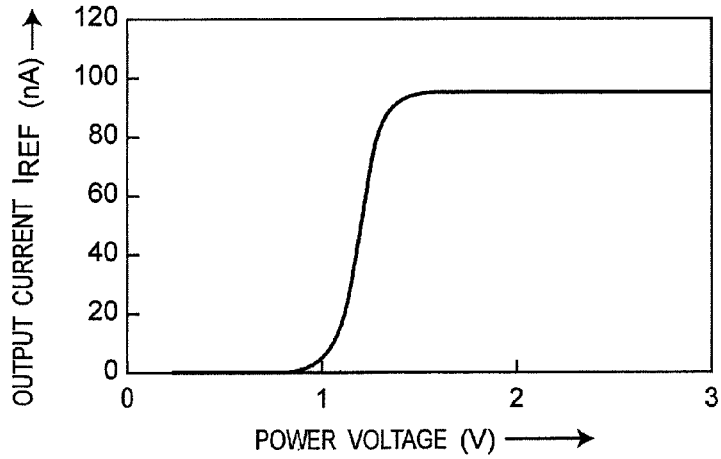
FIG. 14 is a graph showing the output current $I_{REF}$ generated by the reference current source circuit 1C of FIG. 9 at the room temperature with respect to a power supply voltage.

FIG. 14 is a graph showing an output current $I_{REF}$ generated by the reference current source circuit 1C of FIG. 9 at the room temperature with respect to the power supply voltage. As shown in FIG. 14, the reference current source circuit 1C operates normally at a power supply voltage of equal to or larger than 1.8 V. When the power supply voltage is within a range of 1.8 V to 3 V, a line regulation was 1780 ppm/V. As described above, the reference current source circuit 1C can generate the output current $I_{REF}$ stable to temperature changes and power supply voltage fluctuations. In addition, when the power supply voltage was 1.8 V, the power consumption of the reference current source circuit 1C was 598 nW.

Figure 15:
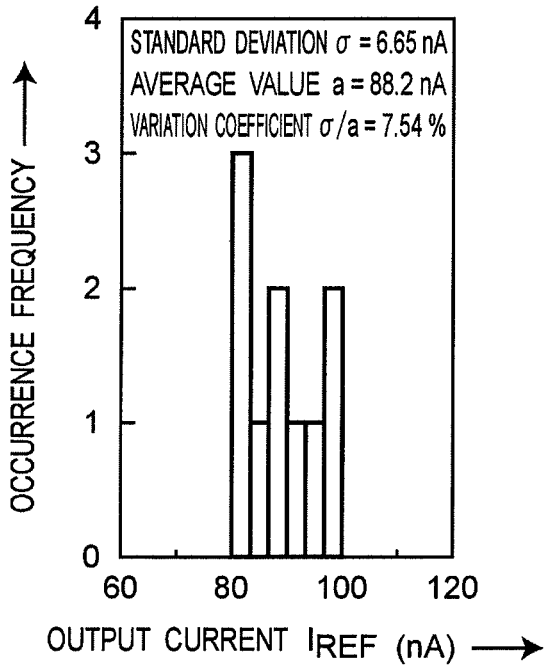
FIG. 15 is a graph showing a distribution of the output current $I_{REF}$ generated by the reference current source circuit 1C of FIG. 9.

FIG. 15 is a graph showing a distribution of the output current $I_{REF}$ generated by the reference current source circuit 1C of FIG. 9. In this case, ten samples were measured at the room temperature. As shown in FIG. 15, with regard to the ten samples, the standard deviation 6 of the output current $I_{REF}$ was 6.65 nA, the average value a was 88.2 nA, and the variation coefficient σ/a was 7.54%.

Table 2 shows performance parameters of the reference current source circuit 1C. For comparison of performance, the performance parameters of the prior art CMOS reference current circuits each generates a minute current are also shown (See the Non-Patent Documents 4 to 6). Referring to Table 2, the reference current source circuit 1C can operate with low power consumption as compared with the prior art CMOS reference current source circuits. In addition, since the reference current source circuit 1C is configured to include the added bias generator circuit 10, the temperature dependence can be improved with the tolerance against the process variations maintained. The reference current source circuit 1C is useful for a low power consumption LSI, and able to be utilized as a reference circuit.

TABLE 2

| | Reference Current Source Circuit of Preferred Embodiment 1C | Prior Art Reference Current Source Circuit (Non-Patent Document 4) | Prior Art Reference Current Source Circuit (Non-Patent Document 5) | Prior Art Reference Current Source Circuit (Non-Patent Document 6) |
|---|---|---|---|---|
| Process | 0.35 μm | — | 0.8 μm | 3 μm |
| Output Current $I_{REF}$ (nA) | 94.9 | 287 | 430 | 774 |
| Power Consumption (nW) | 598 | — | 2150 | 7000 |
| Temperature (° C.) | −20 to 100 | 0 to 75 | — | 0 to 80 |
| Temperature Characteristic $TC_1$ (ppm/° C.) | 523 | 226 | 6000 | 375 |
| Minimum Power supply voltage (V) | 1.8 | — | 2.5 | 3.5 |
| Line Regulation (ppm/V) | 1710 | 4000 | 5000 | 150 |

As described above, according to the reference current source circuit of the present invention, the added bias generator circuit generates the added bias voltage, which has the predetermined temperature coefficient and includes the predetermined offset voltage, and the drain bias voltage generator circuit adds the added bias voltage to the drain bias voltage and applies the voltage of the adding results to the drain of the MOS transistor. Therefore, the inclination of the temperature characteristic of the output current can be controlled to be zero at the room temperature, and the reference current source circuit can supply a constant output current stable to variations (referred to as PVT variations hereinafter) including a process variation, a power supply voltage variation and a temperature variation. In addition, since the added bias generator circuit has one current path, the reference current source circuit of the present invention can be configured to have a circuit area equal to or smaller than half of that of the prior art current source circuit, and the power consumption can be reduced.

In addition, according to the reference current source circuit of the present invention, by using only one common nMOS transistor instead of the first nMOS transistor that operates in the subthreshold saturation region in the added bias generator circuit and the nMOS transistor that operates in the subthreshold saturation region in the drain bias voltage generator circuit, the number of transistors can be reduced as compared with that of the above-described reference current source circuit.

Further, according to the reference current source circuit of the present invention, the reference current source circuit is configured to include the startup circuit, the startup circuit operates only when an operating current is not flowing through the reference current source circuit so as to flow the operating current through the reference current source circuit, and the startup circuit does not operate when the operating current flows through the reference current source circuit. Therefore, the reference current source circuit operates at a normal operating point.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. A reference current source circuit comprising:

a first current mirror circuit for generating a plurality of first minute currents from a power supply voltage, the plurality of first minute currents corresponding to each other;

a MOS transistor having a gate, a drain and a source, and generating an output current based on a voltage induced across the drain and the source;

a gate bias voltage generator circuit comprising a plurality of first MOS transistors operating in a subthreshold saturation region based on a plurality of first minute currents selected from the plurality of first minute currents, generating a gate bias voltage so as to operate the MOS transistor in a strong-inversion linear region based on selected first minute currents, and applying the gate bias voltage to the gate of the MOS transistor;

a drain bias voltage generator circuit comprising a plurality of second MOS transistors operating in the subthreshold saturation region based on a plurality of first minute currents selected from the plurality of first minute currents, generating a drain bias voltage based on selected first minute currents, and applying the drain bias voltage to the drain of the MOS transistor; and an added bias voltage generator circuit for generating an added bias voltage, which has a predetermined temperature coefficient and includes a predetermined offset voltage, based on one first minute current selected from the plurality of first minute currents, so that the output current becomes constant against temperature changes, wherein the drain bias voltage generator circuit adds the added bias voltage to the drain bias voltage, and applies a voltage of adding results to the drain of the MOS transistor as the drain bias voltage.

2. The reference current source circuit as claimed in claim 1, wherein the added bias voltage generator circuit comprises a MOS transistor ladder circuit, wherein the MOS transistor ladder circuit comprises:

a first nMOS transistor which is diode-connected and operates in the subthreshold saturation region based on the one first minute current; and a second nMOS transistor, which is connected in series to the first nMOS transistor via a connection point and operates in a subthreshold linear region based on the one first minute current, and wherein the MOS transistor ladder circuit outputs a voltage generated at the connection point as the added bias voltage.

3. The reference current source circuit as claimed in claim 2, wherein the first nMOS transistor is selected from the plurality of second MOS transistors.

4. The reference current source circuit as claimed in claim 1, wherein the added bias voltage generator circuit comprises a MOS transistor ladder circuit, wherein the MOS transistor ladder circuit comprises:

a first nMOS transistor which is diode-connected and operates in the subthreshold saturation region based on the one first minute current; and a plurality of second nMOS transistors, which are connected in series to the first nMOS transistor via a first connection point, operate in a subthreshold linear region based on the one first minute current, and are connected in series with each other via at least one second connection point, and wherein the MOS transistor ladder circuit outputs a voltage generated at one of the first connection point and the at least one second connection point as the added bias voltage.

5. The reference current source circuit as claimed in claim 4, wherein the first nMOS transistor is selected from the plurality of second MOS transistors.

6. The reference current source circuit as claimed in claim 5, wherein the plurality of second nMOS transistors are connected between the first connection point and a ground, wherein the added bias voltage generator circuit further comprises a plurality of switches connected between the first connection point and the ground, and between each of the at least one second connection point and the ground, respectively, and wherein one of the plurality of switches is controlled to be turned on.

7. The reference current source circuit as claimed in claim 4, wherein the plurality of second nMOS transistors are connected between the first connection point and a ground, wherein the added bias voltage generator circuit further comprises a plurality of switches connected between the first connection point and the ground, and between each of the at least one second connection point and the ground, respectively, and wherein one of the plurality of switches is controlled to be turned on.

8. The reference current source circuit as claimed in claim 1, wherein the first current mirror circuit includes a plurality of cascode current mirror circuits.

9. The reference current source circuit as claimed in claim 1, further comprising a startup circuit, wherein the startup circuit comprises:

a detector circuit for detecting a non-operating time of the reference current source circuit; and a startup transistor circuit for starting up the reference current source circuit by flowing a predetermined startup current through the reference current source circuit when the non-operating time of the reference current source circuit is detected by the detector circuit.

10. The reference current source circuit as claimed in claim 9, wherein the startup circuit further comprises a current supply circuit for supplying a bias operating current to the detector circuit, and wherein the current supply circuit comprises:

a third minute current generator circuit for generating a predetermined second minute current from the power supply voltage; and a second current mirror circuit for generating a third minute current corresponding to the second minute current as the bias operating current.

* * * * *